United States Patent [19]

Alderman

[11] Patent Number: 4,484,594

[45] Date of Patent: Nov. 27, 1984

[54] FREEZE GUARD VALVE

[76] Inventor: Roy Alderman, 2402 South St., Beaumont, Tex. 77702

[21] Appl. No.: 507,498

[22] Filed: Jun. 24, 1983

[51] Int. Cl.[3] ..... E03B 7/12; F16L 55/00

[52] U.S. Cl. ..... 137/62; 137/79; 236/93 A; 237/80

[58] Field of Search ..... 137/60, 61, 62, 79, 137/59; 236/93 A, 99 J, 99 R; 237/80

[56] References Cited

U.S. PATENT DOCUMENTS

| | | | |
|---|---|---|---|
| 1,268,648 | 6/1918 | Van Meter | 137/62 |
| 1,784,041 | 12/1930 | Carson, Jr. | 236/93 A |
| 1,931,863 | 10/1933 | Fonseca | 236/99 R |
| 2,475,556 | 7/1949 | Seligman et al. | 236/93 AU X |
| 2,575,100 | 11/1951 | Duey | 236/93 A |
| 3,369,556 | 2/1968 | Allderdice | 137/79 |
| 3,397,711 | 8/1968 | Strange | 137/62 |
| 3,618,625 | 11/1971 | Walters | 236/93 A |
| 4,286,613 | 9/1981 | Lacoste | 237/80 |

FOREIGN PATENT DOCUMENTS

| | | | |
|---|---|---|---|
| 279804 | 8/1928 | United Kingdom | 236/93 A |
| 534515 | 3/1941 | United Kingdom | 236/93 A |

*Primary Examiner*—George L. Walton

*Attorney, Agent, or Firm*—LeBlanc, Nolan, Shur & Nies

[57] ABSTRACT

A valve device for use in preventing freeze damage caused by water freezing in water pipes in the home or other location. The device includes a cylindrical body portion which houses an apertured retainer plate and a bellows assembly with attached valve stem for coacting with a valve seat located in one end cap. The bellows is initially charged to an expanded condition with a fluid such as a gas mixture which contracts as the temperature approaches the freezing temperature of water. In one embodiment, the length of the valve body may be changed to compensate for changes in ambient temperature and pressure which can affect the relation between valve stem and valve seat.

10 Claims, 4 Drawing Figures

FIG. 1
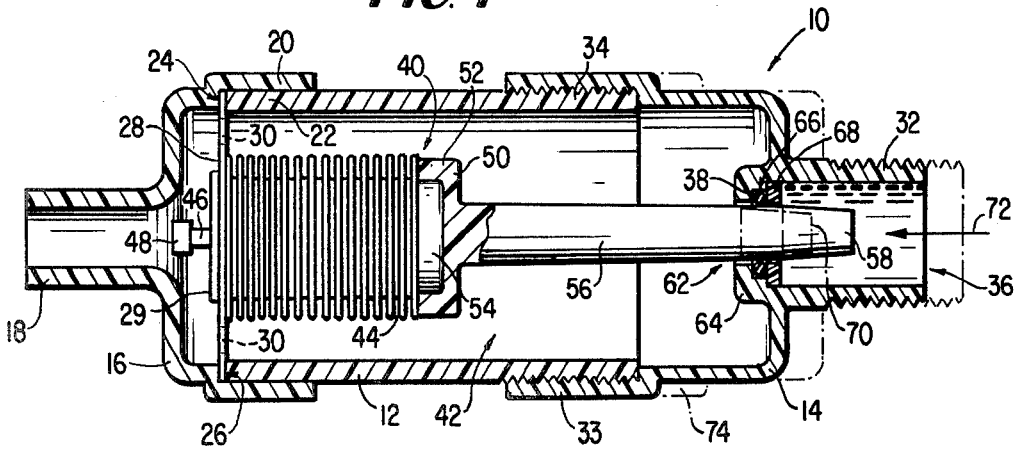
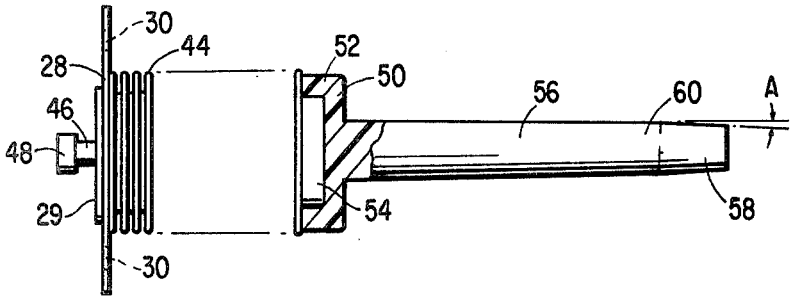
FIG. 2
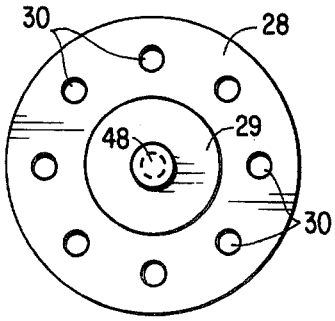
FIG. 3
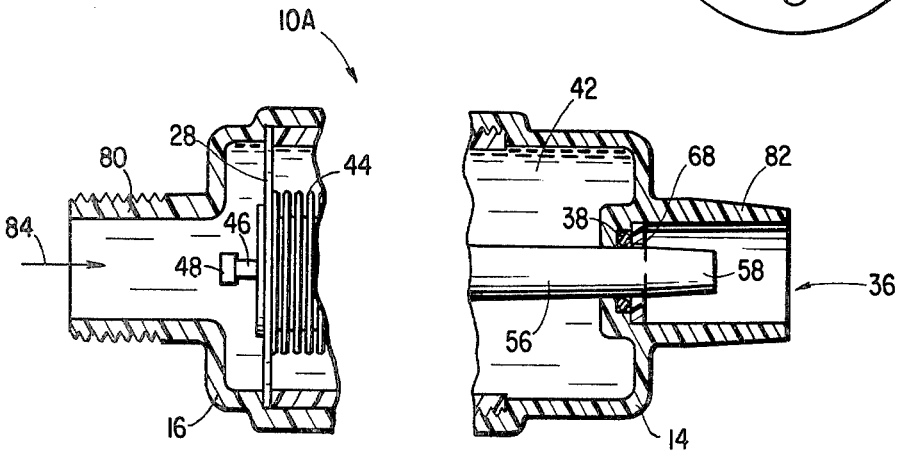
FIG. 4

FREEZE GUARD VALVE

BACKGROUND AND SUMMARY OF THE INVENTION

The present invention relates to a valve device for use in preventing the freezing of water within pipes in the home or other location. More particularly, the present invention relates to a device which may be installed in the water line and which operates to cause water to flow when the temperature drops to freezing, thus preventing the freezing of water within the line.

The present invention is concerned with providing a solution to the problem of water freezing within water pipes when the temperature drops to 32° F. and below. It is well known that the damage which can occur under such conditions is very costly as well as a great inconvenience, frequently requiring extensive repair or replacement of water pipes and other damaged property.

By the present invention there is provided a valve device which can be installed within the water line and which functions to cause water to flow in that portion of the line which is subject to freezing conditions, thus preventing the water from freezing when the temperature drops to about 32° F. and below.

The valve device of the present invention includes a cylindrical body portion which provides a housing for a bellows assembly filled with a fluid which contracts as the ambient temperature drops to the freezing temperature of water.

An end cap is attached at each end of the device. In one embodiment, one end cap has an integral drain connector and is secured on the cylinder so as to maintain an apertured retainer washer in position across the body chamber with an annular axial flange of the end cap fitted over the outer surface of one end of the body portion. The other end cap has an integral faucet or pipe connector and is threadedly attached to the other end of the body portion and provides a through opening including a valve seat for coacting with a valve element attached to the bellows. An O-ring located in an inner recess in the end cap serves as the actual valve seat. Another embodiment has the faucet or pipe connection and the connection to drain reversed relative to the other components. Thus the device can be constructed so that either end is arranged for connection to the water line. In addition, the threaded connection of the end cap carrying the valve seat allows the device to be adjusted for variations in ambient temperature and pressure conditions, thus facilitating use of the device at various elevations.

The bellows assembly is secured within the valve chamber on the retainer washer in coaxial alignment with the O-ring valve seat. A valve element assembly is secured to the bellows and has a stem with a special shaped cylindrical and tapered plug valve end portion which projects through the O-ring valve seat in the second end cap. The bellows is filled with a fluid such as a Freon gas mixture which contracts as the temperature drops and expands as the temperature rises. A charging tube extends through the retainer washer into the interior of the bellows to allow the bellows to be charged under pressure with the contractible fluid prior to assembly and then sealed.

In operation, the device may be attached to the outer end of a water faucet, water pipe or similar water system component subject to occasional freezing temperatures. As the temperature drops to 32° F., causing the gas pressure within the bellows to decrease, the bellows contracts, pulling the stem and valve element away from fluid sealing engagement with the O-ring seat, allowing water to flow into and through the chamber and thence out through the drain hose connection.

The present invention is distinguished from the bellows apparatus as described in the following U.S. Pat. Nos.: 1,268,648 to Van Meter; 1,338,469 to Waage et al; 2,804,758 to Smith et al; 4,286,613 to Lacoste; and 4,356,833 to Mayfield et al.

Various types of bellows apparatus for opening a valve upon contraction or expansion of the bellows are described, for example, in the patents to Waage et al, Van Meter, Smith et al and Mayfield et al. The use of a bellows filled with a gas in a valve device is described in the patents to Lacoste and Van Meter. In each of the devices described by Waage et al, Van Meter, Mayfield et al and Lacoste, a spring biasing means is employed in addition to the action of the temperature responsive member to control the valve.

The present invention is distinguished from such prior art devices by the use of a valve construction wherein a bellows assembly is secured to an apertured retainer washer which is retained within a cylindrical body by an end cap, with the bellows being charged with a fluid to an expanded condition which maintains an internal valve element in seating engagement with a valve seat in a second end cap, and with the bellows contracting under reduced temperature conditions so as to open the valve in the absence of separate spring biasing means. A further distinction is seen in the fact that, in the present invention, the use of a specific combination cylindrical and tapered plug valve cooperating with an O-ring seat is not disclosed in these prior patents.

Accordingly, it is a primary object of the present invention to provide a valve device for use in preventing the freezing of water within water pipes in the home or other location.

It is a further object of the invention to provide a device which allows water to flow through the line as the surrounding temperature drops to the freezing point of water, thus keeping the water pipes open and preventing freezing of water within the pipes.

It is another object of the invention to provide a valve device which can be manufactured economically so as to be widely available to the general public for use in preventing the freezing of water pipes.

It is a further object of the invention to provide a device having few moving parts, and having a bellows assembly which contracts under reduced temperature conditions to open a valve, thus permitting water flow.

It is another object of the invention to provide a freeze valve device which may be adjusted for various temperature and pressure conditions, including changes in atmospheric pressure which occur at high and low elevations, so as to provide protection for water pipes in the home, business or other location.

It is a further object of the invention to provide efficient and reliable protection for water systems during freezing conditions.

BRIEF DESCRIPTION OF THE DRAWINGS

FIG. 1 is a longitudinal cross-sectional view of a first embodiment of the freeze valve device of the present invention.

FIG. 2 is a side elevation in partial cross-section of the bellows assembly employed in the freeze valve device of FIG. 1.

FIG. 3 is an end view from the left side of the assembly shown in FIG. 2.

FIG. 4 is a partial longitudinal cross-sectional view of a second embodiment of the freeze valve device of the present invention.

DESCRIPTION OF THE PREFERRED EMBODIMENTS

In the embodiment of the invention as shown in FIGS. 1-3, there is provided a valve device 10 which includes a cylindrical main body portion 12 having an end cap 14, 16 attached at either end.

The end cap 16 is provided with an integral through conduit 18 to which may be connected a drain hose or other means of removing water which flows through the valve 10 when it is in an open condition. The cap 16 has an annular axial flange 20 which fits over the adjacent end portion 22 of the body portion 12 and retains in position between the outer end surface 24 of the body portion 12 and an inner shoulder 26 of the flange 20 a retainer washer plate 28 having raised central shoulder portion 29 and a plurality of apertures 30 extending around the circumference of the washer plate 28. The end cap 16 is adhesively secured to the adjacent end 22 of the valve body portion 12 and thus maintains the washer plate 28 in a fixed position.

End cap 14 has an integral faucet or pipe connector 32 and an annular axial flange 33 at the outer end of the cap 14 which is threadedly attached to the other end portion 34 of the valve body 12. The end cap 14 provides a through opening 36 within the pipe connector portion 32, including a valve seat in the form of an O-ring 38 for coacting with a valve element of the bellows assembly, as described hereinafter.

A bellows assembly 40 is secured within the chamber 42 defined by the valve body 12 and end caps 14 and 16. The bellows assembly 40 includes a bellows 44 which is secured by suitable adhesive on the retainer washer plate 28 in coaxial alignment with the O-ring valve seat 38. A charging tube 46 extends from a position outwardly of the washer plate 28 into the interior of the bellows 44 for the purpose of allowing the bellows 44 to be charged with a fluid to the desired expanded condition and then sealed. An end cap 48 of conventional construction is located on the outer end of the tube 46 for use in sealing the end of the tube 46 to retain fluid within the bellows 44. In one embodiment, the end of the tube 46 may be sealed by the application of liquid solder.

A valve element assembly 50 is secured to the inner end of the bellows 44 by means of a cup-shaped flange 52 of the valve element which receives and is adhesively secured to a cylindrical member 54 of reduced diameter which forms the inner end of the bellows 44. The valve element assembly 50 also includes a stem 56 which may be formed as a one-piece construction with the flanged portion 52. The stem 56 is generally cylindrical in shape but with a tapered plug valve end portion 58 which projects through the O-ring valve seat 38 when the bellows 44 is in the expanded condition. In one embodiment the entire stem 56 is tapered slightly, from the base or point of attachment to the flanged portion 52 outwardly to the point 60 at which plug valve end portion 58 commences, with a more pronounced taper from that point 60 to the end of the stem 56.

As shown in FIG. 1, the valve stem 56 passes into the opening 36 of the end cap 14, with the stem 56 passing through an opening 62 in an inwardly extending shoulder portion 64 of the end cap 14. The O-ring 38 is located in an inner recess 66 in the shoulder portion 64, with the O-ring 38 being retained in the recess 66 by a ring member 68, of plastic or similar material, which is adhesively secured to the shoulder 64 of the end cap 14. The diameters of the opening 62 and ring 68 relative to that of the O-ring 38 should be such that the stem 56 will engage the O-ring 38 in sealing relationship as the stem passes through the opening 36 in the end cap 14.

The bellows assembly 40 is initially installed in the device 10 with the bellows 44 in the expanded condition after being charged with a suitable fluid such as a Freon gas mixture. In one embodiment, the bellows has an interior diameter of 0.755 inches and with the flanges extending outwardly therefrom to an outside diameter of $1\frac{1}{8}$ inches. The linear amount of bellows collapse in a longitudinal direction as the gas contracts within the bellows 44 due to decreased temperature is approximately $\frac{1}{4}$ inch.

With the bellows 44 in the expanded condition, the stem end 58 will assume a position as shown in full lines in FIG. 1. Upon contraction of the bellows 44 due to reduced temperature conditions, the stem end will withdraw to the dotted line position shown at 70 in FIG. 1, thus opening the valve 10 and allowing water to flow in the direction of the arrow 72 from opening 36 through the chamber 42, passing through the apertures 30 of the washer plate 28 and out through the conduit 18. In one embodiment, the valve 10 will open when the temperature drops to 31.5° F., and will close, sealing off the flow of water, when the temperature has climbed back to 40° F.

The threaded attachment of the end cap 14 to the main body portion 12 of the valve 10 allows the relation between the O-ring 38 and the valve stem end 58 to be adjusted as necessary, such as for variations in temperature and pressure conditions in different geographic locations which can affect the amount of expansion and contraction of the bellows 44. Thus the end cap 14 can be moved to a position shown in dotted lines at 74 in FIG. 1, for example.

In FIG. 4 there is shown an alternative embodiment of the valve 10A in which the connectors at the outer ends of the end caps 14, 16 are reversed compared to FIG. 1. Thus end cap 16 is provided with an integral faucet or pipe connector 80 and end cap 14 is provided with an integral through conduit 82 for connection to a drain hose or other means of removing water which flows through the valve 10. In the embodiment of FIG. 4, water from the system to which the valve 10A is connected would initially fill the chamber 42, moving in the direction of the arrow 84, and would pass on through opening 36 when the valve is opened. A pressure stabilizer device, of conventional construction, may be installed in the water line when using this embodiment, if desired.

While the present invention has been described as being connected at the end of the water piping system to a water faucet or the like, it is also within the scope of the invention to install the valve in a position along the water-line, when such installation is necessary due to the temperature conditions encountered in a particular portion of the water piping system.

In one embodiment, the tapered plug end portion 58 of the bellows valve stem 56 is tapered at an angle A of approximately $4\frac{1}{2}$ degrees relative to a line parallel to the longitudinal axis of the stem 56. In this embodiment, the length of the end portion 58 is approximately $\frac{3}{8}$ inch.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A freeze valve device for connection to a water conduit to protect said conduit from damage due to freezing water in said conduit, comprising: a cylindrical body member having an end cap attached at either end to define a chamber; a retainer washer plate secured to one end of said body member adjacent one of said end caps and extending across the width of said chamber, said one end cap having an opening therein and said retainer washer plate having at least one aperture therein for passage of fluid; the other end cap being threadedly attached to the adjacent end of said body member to allow axial adjustment of said other end cap relative to said cylindrical body member, said other end cap having an opening therein with a valve seat for coacting with a valve element to vary the amount of water through the opening in said other end cap as said other end cap is movably adjusted along said cylindrical body member to position said valve element relative to the valve opening; a bellows assembly secured within the valve chamber on the retainer washer plate for aligning said bellows assembly with said valve seat, said bellows assembly having a bellows which is capable of being charged with a fluid to a longitudinally expanded condition and also capable of contracting longitudinally as said fluid contracts under reduced temperature conditions; a valve element secured to the bellows which is directly aligned with the opening in said other end cap as said other end cap is moved along said cylindrical body member, said valve element having a stem which extends longitudinally from said bellows through the opening in said other end cap and coacting with said valve seat to close said opening to fluid flow when the bellows is in an expanded condition.

2. The freeze valve device of claim 1 wherein an O-ring is positioned within an inner recess surrounding the opening in said other end cap to provide said valve seat, said O-ring coacting with said valve stem to provide closure of said opening when the bellows is in an expanded condition.

3. The freeze valve device of claim 1, further including a charging tube in fluid communication with the interior of said bellows and extending outwardly of said retainer washer plate to allow the bellows to be filled with a contractible fluid.

4. The freeze valve device of claim 1 wherein said one end cap overlies said retainer washer plate and has an annular axial flange which fits over the outer surface of one end of said body member.

5. The freeze valve device of claim 1 wherein said valve stem is of a generally cylindrical shape, with a tapered cylindrical end portion of reduced diameter.

6. The freeze valve device of claim 5 wherein said end portion of the valve stem is tapered at an angle of approximately $4\frac{1}{2}$ degrees.

7. The freeze valve device of claim 1 wherein said one end cap has a through conduit for attachment to drain means for removing water and wherein said other end cap has an integral faucet or pipe connector.

8. The freeze valve device of claim 1 wherein said one end cap has an integral faucet or pipe connector and said other end cap has a through conduit for attachment to drain means for removing water.

9. The freeze valve device of claim 1 wherein the bellows assembly and valve element are coaxially aligned with the openings in the end caps at either end of said device.

10. The freeze valve device of claim 9 wherein said retainer washer plate is provided with a plurality of apertures extending around the periphery of said plate.

* * * * *